US012326146B2

(12) United States Patent
Kim et al.

(10) Patent No.: US 12,326,146 B2
(45) Date of Patent: Jun. 10, 2025

(54) APPARATUS FOR CONTROLLING COMPRESSOR, COMPRESSOR AND METHOD FOR CONTROLLING COMPRESSOR

(71) Applicant: LG ELECTRONICS INC., Seoul (KR)

(72) Inventors: Youngsung Kim, Seoul (KR); Youngbong Cho, Seoul (KR); Jaeheung Kim, Seoul (KR); Hyeongseok Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 451 days.

(21) Appl. No.: 17/721,736

(22) Filed: Apr. 15, 2022

(65) Prior Publication Data

US 2022/0397112 A1 Dec. 15, 2022

(30) Foreign Application Priority Data

Jun. 15, 2021 (KR) ..... 10-2021-0077643

(51) Int. Cl.
*F04B 49/20* (2006.01)
*F04B 49/06* (2006.01)

(52) U.S. Cl.
CPC ..... *F04B 49/20* (2013.01); *F04B 49/06* (2013.01); *F04B 2201/0201* (2013.01); *F04B 2203/0208* (2013.01); *F04B 2205/03* (2013.01)

(58) Field of Classification Search
CPC ..... F04B 49/20; F04B 2201/0201; F04B 2203/0208; F04B 2205/03
See application file for complete search history.

(56) References Cited

U.S. PATENT DOCUMENTS 5,017,854 A * 5/1991 Gully ..... F04B 35/045 318/599
6,832,898 B2 12/2004 Yoshida et al.
8,109,736 B2 * 2/2012 Yoo ..... H02P 25/06 318/135
8,197,220 B2 * 6/2012 Sung ..... F04B 49/12 318/400.14
8,221,090 B2 * 7/2012 Kim ..... F04B 35/045 417/44.11
9,850,890 B2 * 12/2017 Lim ..... F04B 49/06
10,436,191 B2 * 10/2019 Ryu ..... F25B 1/02
11,073,147 B2 * 7/2021 Brett ..... F04B 53/1082
(Continued)

FOREIGN PATENT DOCUMENTS

EP 2016669 1/2009
EP 2023480 2/2009
(Continued)

OTHER PUBLICATIONS

Machine Translation of KR 20200000105A.*
(Continued)

*Primary Examiner* — Christopher S Bobish
(74) *Attorney, Agent, or Firm* — Fish & Richardson P.C.

(57) ABSTRACT

A compressor control apparatus and method differently compensate for a duty ratio of a control signal during a period in which the compressor performs a compression stroke and a period in which the compressor performs a suction stroke, respectively, to generate the control signal for controlling a compressor.

18 Claims, 10 Drawing Sheets

(56) References Cited

U.S. PATENT DOCUMENTS

| | | | | |
|---|---|---|---|---|
| 11,290,049 | B2 * | 3/2022 | Luh | F04B 49/20 |
| 11,859,600 | B2 * | 1/2024 | Tsukada | F04B 49/06 |
| 2003/0164691 | A1 * | 9/2003 | Ueda | F04B 35/045 318/135 |
| 2012/0076667 | A1 * | 3/2012 | Patient | B60T 8/4068 417/44.1 |
| 2016/0053754 | A1 * | 2/2016 | Kang | F04B 35/045 417/45 |
| 2019/0078565 | A1 * | 3/2019 | Carman | F04B 49/20 |
| 2019/0264676 | A1 | 8/2019 | Merkel et al. | |
| 2021/0164458 | A1 * | 6/2021 | Carman | F04B 49/065 |
| 2022/0412334 | A1 * | 12/2022 | Muller et al. | F04B 43/0081 |

FOREIGN PATENT DOCUMENTS

| | | |
|---|---|---|
| EP | 2708835 | 3/2014 |
| JP | 2004-522063 | 7/2004 |
| KR | 10-2018-0109262 | 10/2018 |
| KR | 20200000105 | 1/2020 |
| WO | WO2007123323 | 11/2007 |

OTHER PUBLICATIONS

Extended European Search Report in European Appln. No. Application 22166705.8, dated Sep. 29, 2022, 33 pages.
Notice of Allowance in Korean Application No. 10-2021-0077643, dated Jan. 22, 2024, 8 pages (with English translation).

* cited by examiner

| Total | U | V | W |
|---|---|---|---|
| 0.870 | 0.272 | 0.305 | 0.293 |

| | -24% | -21% | -25% | -27% |
|---|---|---|---|---|
| Total | U | V | W | |
| 0.664 | 0.213 | 0.229 | 0.221 | |

APPARATUS FOR CONTROLLING COMPRESSOR, COMPRESSOR AND METHOD FOR CONTROLLING COMPRESSOR

CROSS-REFERENCE TO RELATED APPLICATIONS

Pursuant to 35 U.S.C. § 119(a), this application claims the benefit of an earlier filing date of and the right of priority to Korean Patent Application No. 10-2021-0077643, filed on Jun. 15, 2021, the contents of which are incorporated by reference herein in their entirety.

BACKGROUND

Technical Field

The embodiment relates to a compressor control apparatus, a compressor, and a compressor control method for the operation control of the compressor.

Description of Related Art

The background technology of the embodiment relates to control of a compressor, and more particularly, to control according to an operation region of a reciprocating compressor used for a refrigerator.

Due to the characteristics of the operation of the refrigerator, it is required to improve power consumption and increase an operation rate for a steady temperature operation. In particular, in the case of operating characteristics at an actual load (RT16° C.) due to the strengthening of energy regulations, since the operation rate is low and an intermittent operation is performed in parallel, an expansion of a low-speed operation region is required due to the deterioration of power consumption, but there is a limit due to a decrease in compressor efficiency and a vibration problem as the rotational speed decreases. This is because, as the operating speed is lower, rotational energy is greatly reduced, and vibration is induced due to a speed difference between a compression period and a suction period corresponding to a load, and the compressor efficiency decreases due to an increase in the used current required to respond to the load.

On the other hand, in the related art, a method of reducing vibration by compensating a current prior to the top dead center of a piston (or during a maximum compression load period) to accelerate a speed of the compression stroke has been proposed, but in the case of the related art, an increase in pressure is unavoidable due to an increase in the used current, and there is a limit that the efficiency of the compressor is lowered.

As a result, technologies capable of solving vibration and efficiency problems at the same time have not been proposed in the related art, and accordingly, there is a restriction on operation in a low-speed region.

SUMMARY

An aspect of the present disclosure is to overcome the limitations of the related art as described above.

In other words, the present disclosure is intended to provide embodiments of a compressor control apparatus, a compressor, and a compressor control method capable of overcoming the limitations of the related art as described above.

Specifically, the present disclosure is intended to provide embodiments of a compressor control apparatus, a compressor, and a compressor control method in which appropriate compensation is carried out for each stroke period, thereby overcoming the limitations of vibration increase and efficiency reduction.

In particular, the present disclosure is intended to provide embodiments of a compressor control apparatus, a compressor, and a compressor control method capable of improving efficiency while suppressing the generation of vibration in a low-speed operation region.

Furthermore, the present disclosure is intended to provide embodiments of a compressor control apparatus, a compressor, and a compressor control method capable of expanding an operation region and increasing an operation rate to reduce power consumption in a reciprocating compressor used in a refrigerator.

In order to solve the foregoing problems, according to embodiments of the present specification, a control signal may be generated by differently compensating a duty ratio of the control signal during a period in which the compressor performs a compression stroke and a period in which the compressor performs a suction stroke, respectively, as a means of solution.

For instance, the control signal may be generated by compensating a duty ratio of the control signal according to a first compensation reference while the compressor performs a compression stroke, and compensating a duty ratio of the control signal according to a second compensation reference while the compressor performs a suction stroke.

Alternatively, the control signal may be generated by compensating the duty ratio of the control signal according to a preset first compensation reference while the air is compressed by the compressor, and compensating the duty ratio of the control signal according to a preset second compensation reference while the compressed air is discharged from the compressor.

Alternatively, the control signal may be generated by compensating the duty ratio of the control signal according to a preset first compensation reference from a time point at which a piston of the compressor is positioned at the bottom dead center to a time point at which a valve of the cylinder is opened, and compensating the duty ratio of the control signal according to a preset second compensation reference from a time point at which the valve is closed to a time point at which an internal pressure of the cylinder is reduced to a predetermined level.

Alternatively, an operation of the compressor may be controlled by dividing a plurality of stroke periods according to a change of the internal pressure to vary the compensation of a current applied to the motor for each of the plurality of stroke periods.

On the other hand, in the case of determining and controlling the stroke period of the compressor, the operation of the compressor may be controlled by determining a current stroke period based on the operating state of the compressor to compensate a compensation value corresponding to the current operating period.

In particular, when the compressor operates at an operating frequency below a preset reference frequency, that is, when the compressor operates in a low-speed region, each current compensation may vary during a compression stroke and a suction stroke, respectively.

As described above, through a technical feature of varying compensation between the compression stroke and the suction stroke, efficiency may be improved while reducing vibration in a low-speed operation region, thereby solving the above-described problems.

The foregoing technical feature may be applied and implemented to at least one of a compressor control apparatus of controlling an operation of a compressor, a system of controlling a compressor, a compressor, a compressor system, a compressor control method, a method of controlling a compressor, a method of operating a compressor, a method of performing a stroke of a compressor, and a method of controlling a compensation of a compressor, and the present specification provides embodiments of a compressor control apparatus, a compressor, and a compressor control method using the above technical feature as a means of solution.

An embodiment of a compressor control apparatus of the present specification having the technical features as a means of solution, which is a control apparatus of a compressor that controls an operation of a compressor, may include an inverter unit that converts power received from an external power source into driving power for driving a motor of the compressor to apply the converted power to the motor; and a control unit that detects at least one of a magnitude of the driving power, a position of a piston of the compressor, and an internal pressure of a cylinder in which a reciprocating movement of the piston is carried out to generate a pulse width modulation (PWM) control signal for controlling a switching operation of the inverter unit based on the detection result, and applies the control signal to the inverter unit to control the switching operation, wherein the control unit differently compensates for a duty ratio of the control signal when the compressor performs a compression stroke and a suction stroke, respectively, to generate the control signal.

An embodiment of a compressor of the present specification having the technical feature as a means of solution may include a piston that performs a reciprocating movement by a rotation of a motor; a cylinder in which the reciprocating movement of the piston is carried out; a valve that controls the air inflow and outflow of the cylinder; and a control apparatus that controls the application of driving power according to at least one of a level of the driving power applied to the motor, a position of the piston, and an internal pressure of the cylinder to control the operation of the compressor, wherein when an operating speed of the compressor is below a preset reference speed, the control apparatus varies a compensation of a current applied to the motor for each of a plurality of stroke periods divided according to a change of the internal pressure to control the operation of the compressor.

An embodiment of a compressor control method of the present specification having the technical feature as a means of solution, which is a compressor control method of a compressor control apparatus including an inverter unit that converts power received from an external power source into driving power for driving a motor of a compressor to apply the converted power to the motor; and a control unit that generates a pulse width modulation (PWM) control signal for controlling a switching operation of the inverter unit, and applies the control signal to the inverter unit to control the switching operation, may include comparing an operating speed of the compressor with a preset reference speed; determining a stroke period of the compressor based on at least one of a magnitude of the driving power, a position of a piston of the compressor, and an internal pressure of a cylinder in which a reciprocating movement of the piston is carried out when the operating speed is below the reference speed; compensating a current compensation value corresponding to a current stroke period for a control command that is a basis for the generation of the control signal based on a compensation reference set differently in advance for each stroke period; and generating the control signal according to the control command to apply the generated control signal to the inverter unit.

In addition, another embodiment of a compressor control method of the present specification having the technical feature as a means of solution, which is a compressor control method of a compressor control apparatus including an inverter unit that converts power received from an external power source into driving power for driving a motor of a compressor to apply the converted power to the motor; and a control unit that detects at least one of a magnitude of the driving power, a position of a piston of a compressor, and an internal pressure of a cylinder in which a reciprocating movement of the piston is carried out to generate a pulse width modulation (PWM) control signal for controlling a switching operation of the inverter unit based on the detection result, and applies the control signal to the inverter unit to control the switching operation, may include compensating a compensation value 1-1 for a duty ratio of the control signal from a time point at which the piston is positioned at the bottom dead center to a time point when the piston is moved to a specific position; compensating a compensation value 1-2 that is above the compensation value 1-1 for the duty ratio from a time point at which the piston is positioned at the specific position to a time point at which a valve of the cylinder is opened; not compensating a compensation value for the duty ratio from a time point when the valve is opened to a time point prior to a time point at which the piston is positioned at the top dead center by a predetermined time period; compensating for a compensation value 2-1 for the duty ratio from a time point prior to a time point at which the piston is positioned at the top dead center by a predetermined time period to a time point at which the discharge of compressed air from the cylinder is ended; and compensating a compensation value 2-2 that is below the compensation value 2-1 for the duty ratio from a time point at which the discharge of compressed air from the cylinder is ended to a time point at which the piston is positioned at the bottom dead center.

A compressor control apparatus, a compressor, and a compressor control method according to embodiments may vary compensation during a compression stroke and a suction stroke, thereby having an effect capable of performing appropriate compensation for each stroke period.

Accordingly, efficiency may be improved while improving vibration in a low-speed operation region.

Furthermore, the generation of vibration may be suppressed in the low-speed operation region while improving efficiency, thereby having an effect capable of increasing applicability, stability, effectiveness, and reliability in the low-speed operation region.

Accordingly, the operation region may be expanded and the operation rate may be enhanced, thereby reducing power consumption.

As a result, there is an effect capable of not only overcoming the limitations of the related art, but also increasing the utility and usability of a product family using the compressor.

DETAILED DESCRIPTION

Figure 1:
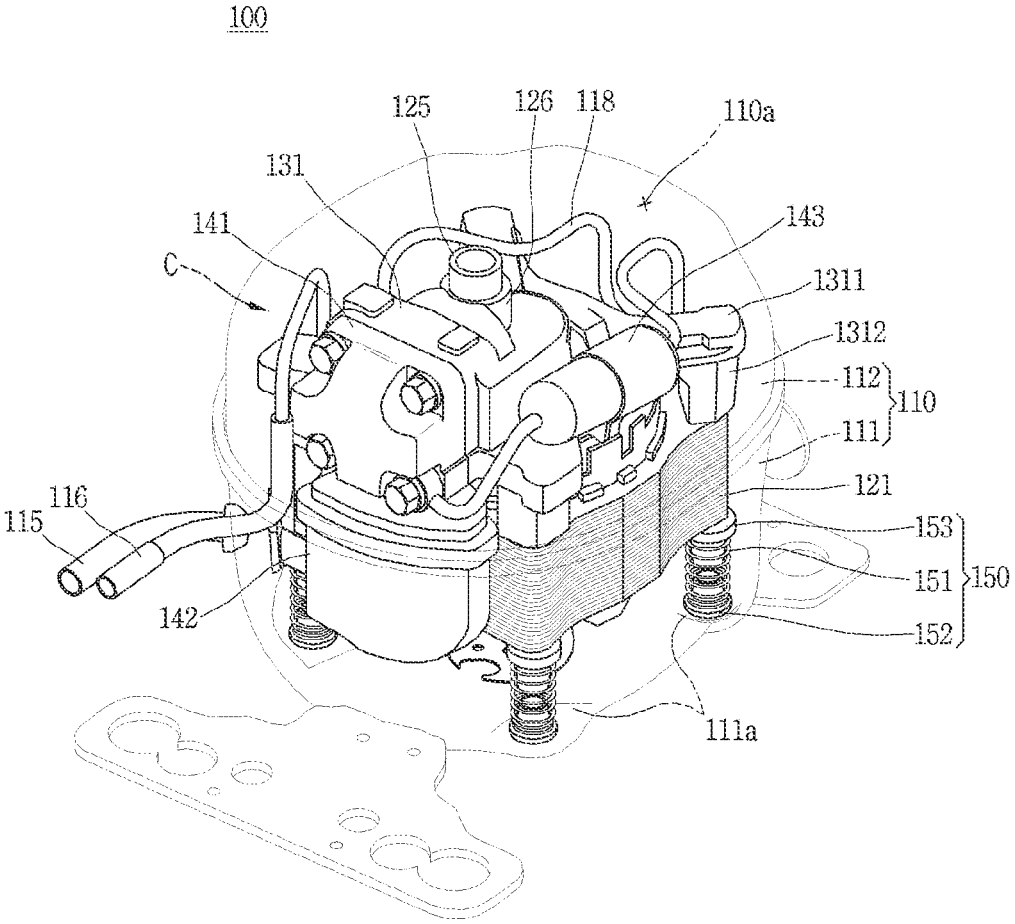
FIG. 1 is a perspective view showing an inside through a shell of a reciprocating compressor according to an example.

Hereinafter, the embodiments disclosed herein will be described in detail with reference to the accompanying drawings, and the same or similar elements are designated with the same numeral references regardless of the numerals in the drawings and their redundant description will be omitted. In describing an embodiment disclosed herein, moreover, the detailed description will be omitted when specific description for publicly known technologies to which the invention pertains is judged to obscure the gist of the present disclosure.

Also, it should be understood that the accompanying drawings are merely illustrated to easily explain the concept of the invention, and therefore, they should not be construed to limit the technological concept disclosed herein by the accompanying drawings, and the concept of the present disclosure should be construed as being extended to all modifications, equivalents, and substitutes included in the concept and technological scope of the invention.

<Basic Configuration of Compressor>

First, a basic configuration of a compressor to which an embodiment is applied will be described as an example with reference to FIGS. 1 and 2.

Figure 2:
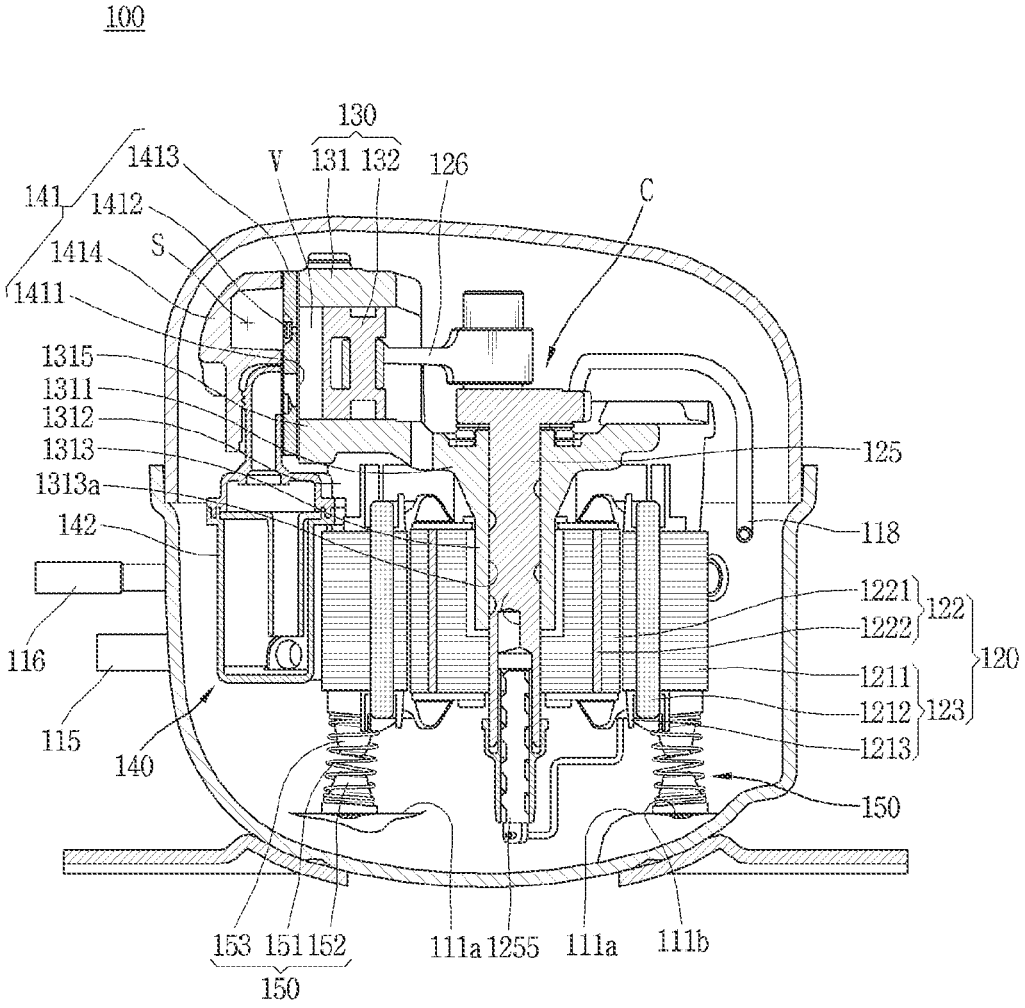
FIG. 2 is a cross-sectional view showing an inside of the reciprocating compressor according to FIG. 1.

The compressor shown in FIGS. 1 and 2 shows an example of a hermetic reciprocating compressor, and the embodiment of the present specification may also be implemented differently from the example shown in FIGS. 1 and 2, and may also be applied to a compressor other than the illustrated example.

Referring to FIGS. 1 and 2, a compressor 100 according to an example includes a shell 110, an electric motor unit 120 provided in an inner space 110*a* of the shell 110 to provide a driving force, a compression unit 130 that receives the driving force from the electric motor unit 120 to compress refrigerant, a suction/discharge unit 140 that guides the refrigerant to a compression chamber and discharges the compressed refrigerant, and a support part 150 that supports a compressor body C including the electric motor unit 120 and the compression unit 130 with respect to the shell.

The inner space 110*a* of the shell 110 is sealed to receive the electric motor unit 120 and the compression unit 130. The shell 110 is made of an aluminum alloy (hereinafter, abbreviated as aluminum) having a light weight and a high heat transfer coefficient, and includes a base shell 111 and a cover shell 112.

The base shell 111 is defined in a substantially hemispherical shape. A suction pipe 115, a discharge pipe 116 and a process pipe 117 are each passed through and coupled to the base shell 111. The suction pipe 115, the discharge pipe 116, and the process pipe 117 may each be coupled to the base shell 111 by an insert die casting method.

In addition, a cap seating surface on which a first spring cap 152 to be described later is seated is disposed on a bottom surface of the base shell 111, and a cap receiving groove 111*b* that supports a first spring cap 152 is disposed on the cap seating surface 111*a*.

The cap seating surface 111*a* may be defined in an annular shape over an entire bottom surface of the base shell 111, but may be disposed to correspond to the number of the first spring caps (or support springs) 152. For example, when the first spring caps 152 are radially disposed at four places as in the present embodiment, the cap seating surfaces may also be radially disposed at four places from on the bottom surface of the base shell.

The cap receiving groove 111*b* and a cap fixing groove 111*c* may be disposed on the cap seating surface 111*a*.

The cap receiving groove 111*b* may be disposed to correspond to a lower surface shape of the first spring cap 152 to be described later. Specifically, a first cap fixing surface 1521*a* constituting a lower surface of the first spring cap 152 may be disposed with a first cap support protrusion 1521*b* that is convex toward the center. Accordingly, the cap receiving groove 111*b* may be defined in a concave shape toward the center to correspond to the first cap support protrusion 1521*b*.

The cap fixing groove 111*c* may be disposed to correspond to the cap fixing protrusion 1521*c* provided on a lower surface of the first spring cap 1521 to be described later. Specifically, the cap fixing groove 111*c* may be disposed to be recessed in an angled cross-sectional shape such as a rectangular parallelepiped inside the cap receiving groove 111*b*. Through this, the first spring cap 152 may be effectively suppressed from being pushed in a radial direction due to the expansion of a contact area with the cap fixing protrusion 1521*c* to be described later.

Although not shown in the drawings, the positions of the cap fixing protrusion and the cap fixing groove may be disposed opposite to those of the above-described embodiment. For example, the cap fixing protrusion may be disposed on the cap seating surface of the base shell, and the cap fixing groove facing the cap fixing protrusion may be disposed on the cap fixing surface of the first spring cap.

The cover shell 112 is defined in a substantially hemispherical shape like the base shell 111. The cover shell 112 is coupled to the base shell 111 on an upper side of the base shell 111 to form the inner space 110*a* of the shell 110.

Furthermore, the cover shell 112 and the base shell 111 may be coupled by welding, but may be bolted together when the base shell 111 and the cover shell 112 are formed of an aluminum material that is difficult to weld.

Next, the electric motor unit will be described.

Referring to FIGS. 1 and 2, the electrical motor unit 120 according to an embodiment includes a stator 121 and a rotor 122.

The stator 121 is elastically supported against the inner space 110*a* of the shell 110, that is, the bottom surface of the base shell 111, and the rotor 122 is rotatably provided at an inner side of the stator 121.

The stator 121 according to the present embodiment includes a stator core 1211 and a stator coil 1212.

The stator core 1211 is made of a metal material such as an electrical steel sheet to perform electromagnetic interaction through an electromagnetic force together with the stator coil 1212 and the rotor 122 to be described later when a voltage is applied to the electric motor unit 120 from the outside.

Furthermore, the stator core 1211 is defined in a substantially rectangular cylindrical shape. For example, an inner circumferential surface of the stator core 1211 may be defined in a circular shape, and an outer circumferential surface thereof may be defined in a rectangular shape. Bolt holes 1211*a* (see FIG. 9) are disposed through four corners of the stator core 1211, respectively, and the stator fastening bolts 1215 are fastened to a cylinder block 131 to be described later through the bolt holes 1211*a*, respectively. Accordingly, the stator core 1211 is fixed to a lower surface of the cylinder block 131 by the stator fastening bolt 1215.

In addition, in a state where the stator core 1211 is spaced apart from an inner surface of the shell 110 in axial and radial directions, a lower end of the stator core 1211 is supported by a support spring 151 to be described later with respect to the bottom surface of the shell 110. Accordingly, vibration generated during operation may be suppressed from being directly transmitted to the shell 110.

The stator coil 1212 is wound at an inner side of the stator core 1211. As described above, when a voltage is applied from the outside, the stator coil 1212 generates an electromagnetic force to perform electromagnetic interaction together with the stator core 1211 and the rotor 122. Through this, the electric motor unit 120 generates a driving force for a reciprocating movement of the compression unit 130.

An insulator 1213 is disposed between the stator core 1211 and the stator coil 1212. Accordingly, direct contact between the stator core 1211 and the stator coil 1212 may be suppressed to efficiently perform electromagnetic interaction.

The rotor 122 according to an example includes a rotor core 1221 and a magnet 1222.

The rotor core 1221, similar to the stator core 1211, is made of a metal material such as an electrical steel sheet, and defined in a substantially cylindrical shape. A crankshaft 125 to be described later may be press-fitted and coupled to the center of the rotor core 1221.

The magnet 1222 may be made of a permanent magnet, and may be inserted and coupled at equal intervals along a circumferential direction of the rotor core 1221. The rotor 122 rotates through electromagnetic interaction with the stator core 1211 and the stator coil 1212 when a voltage is applied. Accordingly, a rotational force of the electric motor unit 120 is transmitted to the compression unit 130 through a connecting rod 126 while the crankshaft 125 rotates together with the rotor 122.

Next, the compression unit will be described.

Referring to FIGS. 1 and 2, the compression unit 130 according to an example includes a cylinder block 131 and a piston 132. The cylinder block 131 is elastically supported by the shell 110, and the piston 132 is coupled to the crankshaft 125 by the connecting rod 126 to perform a relative movement with respect to the cylinder block 131.

The cylinder block 131 according to an example is provided at an upper side of the electric motor unit 120. The cylinder block 131 includes a frame part 1311, a fixing protruding part 1312 coupled to the stator 121 of the electric motor unit 120, a shaft receiving part 1313 that supports the crankshaft 125, and a cylinder unit 1315 that defines a compression chamber V.

The frame part 1311 may be defined in a flat plate shape extending in a transverse direction, or may be defined in a radiating plate shape by removing part of edges thereof except for corners thereof.

The fixing protruding part 1312 is disposed at an edge of the frame part 1311. For example, the fixing protruding part 1312 may be disposed to protrude downward from an edge of the frame part 1311 toward the electric motor unit 120.

Furthermore, a fastening hole (not shown) is disposed in the fixing protruding part 1312 provided in the stator 121 to communicate with the bolt hole 1211*a*. Accordingly, the cylinder block 131 may be fastened to the stator 121 by the stator fastening bolt 1215 to be described later, and may be elastically supported by the base shell 111 together with the stator 121 of the electric motor unit 120.

The shaft receiving part 1313 may be disposed to extend from a center portion of the frame part 1311 in both axial directions. A shaft receiving hole 1313*a* may be disposed to pass through the shaft receiving part 1313 in an axial direction to allow the crankshaft 125 to pass therethrough, and a bush bearing may be inserted into and coupled to an inner circumferential surface of the shaft receiving hole 1313*a*.

Furthermore, a plate part 1253 of the crankshaft 125 may be supported in an axial direction at an upper end of the shaft receiving part 1313, and a bearing part 1252 of the crankshaft 125 may be supported in a radial direction on an inner circumferential surface of the shaft receiving part 1313. Accordingly, the crankshaft 125 may be supported in axial and radial directions by the cylinder block 131.

The cylinder unit 1315 (hereinafter, abbreviated as a cylinder) is disposed in a radially eccentric manner from one edge of the frame part 1311. The cylinder 1315 is passed through in a radial direction to allow the piston 132 connected to the connecting rod 126 to be inserted into an inner opening end thereof, and a valve assembly 141 constituting the suction/discharge unit 140 to be described later is mounted on an outer opening end thereof.

A side (rear side) of the piston 132 facing the connecting rod 126 according to an example is open, while a front side that is opposite thereto is defined in a closed shape. Accordingly, the connecting rod 126 is inserted into and rotatably coupled to a rear side of the piston 132, and a front side of the piston 132 is defined in a closed shape to form the compression chamber V inside the cylinder 1315 together with the valve assembly 141 to be described later.

Furthermore, the piston 132 may be formed of the same material as that of the cylinder block 131, for example, an aluminum alloy. Accordingly, transmitting a magnetic flux from the rotor 122 to the piston 132 may be suppressed.

In addition, as the piston 132 is formed of the same material as that of the cylinder block 131, thermal expansion coefficients of the piston 132 and the cylinder block 131 (specifically, cylinder) will be the same. Accordingly, even though the inner space 110*a* of the shell 110 is in a high temperature state (approximately 100° C.) when the compressor 100 is driven, interference due to thermal expansion between the cylinder block 131 and the piston 132 can be suppressed.

Next, the suction/discharge unit will be described.

Referring to FIGS. 1 and 2, the suction/discharge unit 140 according to an example includes the valve assembly 141, a suction muffler 142, and a discharge muffler 143. The valve assembly 141 and the suction muffler 142 are sequentially coupled to each other from an outer opening end of the cylinder 1315.

The valve assembly 141 according to an example is provided with a suction valve 1411 and a discharge valve 1412 to be coupled to an end portion of the cylinder block 131. The suction valve 1411 and the discharge valve 1412 may be provided separately, but may typically be configured together on the same valve plate.

The suction valve 1411 opens and closes in a direction toward the piston 132, while the discharge valve 1412 opens and closes in a direction opposite to the suction valve 1411. Accordingly, the suction valve 1411 may not be provided with a separate retainer, while the discharge valve 1412 is provided with a retainer (no reference numeral) that limits an opening amount of the discharge valve 1412.

Furthermore, the valve assembly 141 may further include a valve plate 1413 that supports the suction valve 1411 and a cylinder cover 1414 coupled to the valve plate 1413 to support the suction muffler 142.

The valve plate 1413 may be bolted to the cylinder block 131 together with the cylinder cover 1414, and a discharge space S may be formed in the cylinder cover 1414, and connected to the discharge muffler 143 to be described later through a loop pipe 118.

The suction muffler 142 according to an example transfers refrigerant sucked through the suction pipe 115 to the compression chamber V of the cylinder 1315. The suction muffler 142 may be fixedly coupled to an end surface of the cylinder block 131 by the valve assembly 141 or a separate clamp (not shown).

A suction space portion (no reference numeral) is formed inside the suction muffler 142. An inlet of the suction space portion communicates directly or indirectly with the suction pipe 115, and an outlet of the suction space portion communicates directly with a suction side of the valve assembly 141.

The discharge muffler 143 according to an example may be provided separately from the cylinder block 131.

A discharge space portion (no reference numeral) is formed inside the discharge muffler 143. An inlet of the discharge space portion may be connected to a discharge side of the valve assembly 141 by the loop pipe 118, and an outlet of the discharge space portion may be directly connected to the discharge pipe 116 by the loop pipe 118.

<Compressor Control Apparatus>

Hereinafter, an embodiment of a compressor control apparatus (hereinafter, referred to as a control apparatus) will be described.

Figure 3:
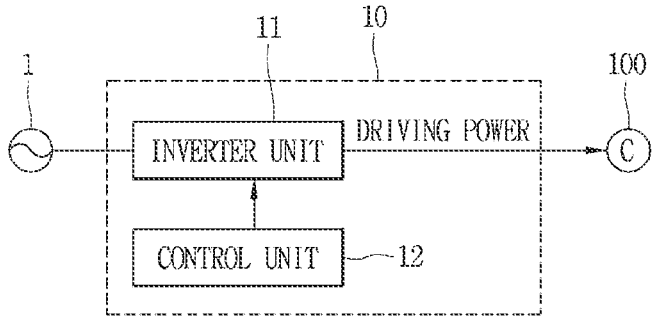
FIG. 3 is a block diagram of a compressor control apparatus according to an embodiment.

As shown in FIG. 3, the control apparatus 10 denotes a control apparatus including an inverter unit 11 and a control unit 12 to control the operation of the compressor 100 as shown in FIGS. 1 and 2.

The control apparatus 10 may supply driving power to a motor of the compressor 100 to control the operation of the compressor 100.

The control apparatus 10 may control the operation of the compressor 100 by controlling the driving of the motor in an inverter method.

In other words, the control apparatus 10 may be an inverter that controls the operation of the compressor 100 or an apparatus including the inverter.

The control apparatus 10 may control the switching operation of the inverter to control operating power applied to the motor, thereby controlling the driving of the motor.

The control apparatus 10 may control the driving power through the control of the switching operation to control the driving of the motor, thereby controlling the operation of the compressor 100.

Figure 4:
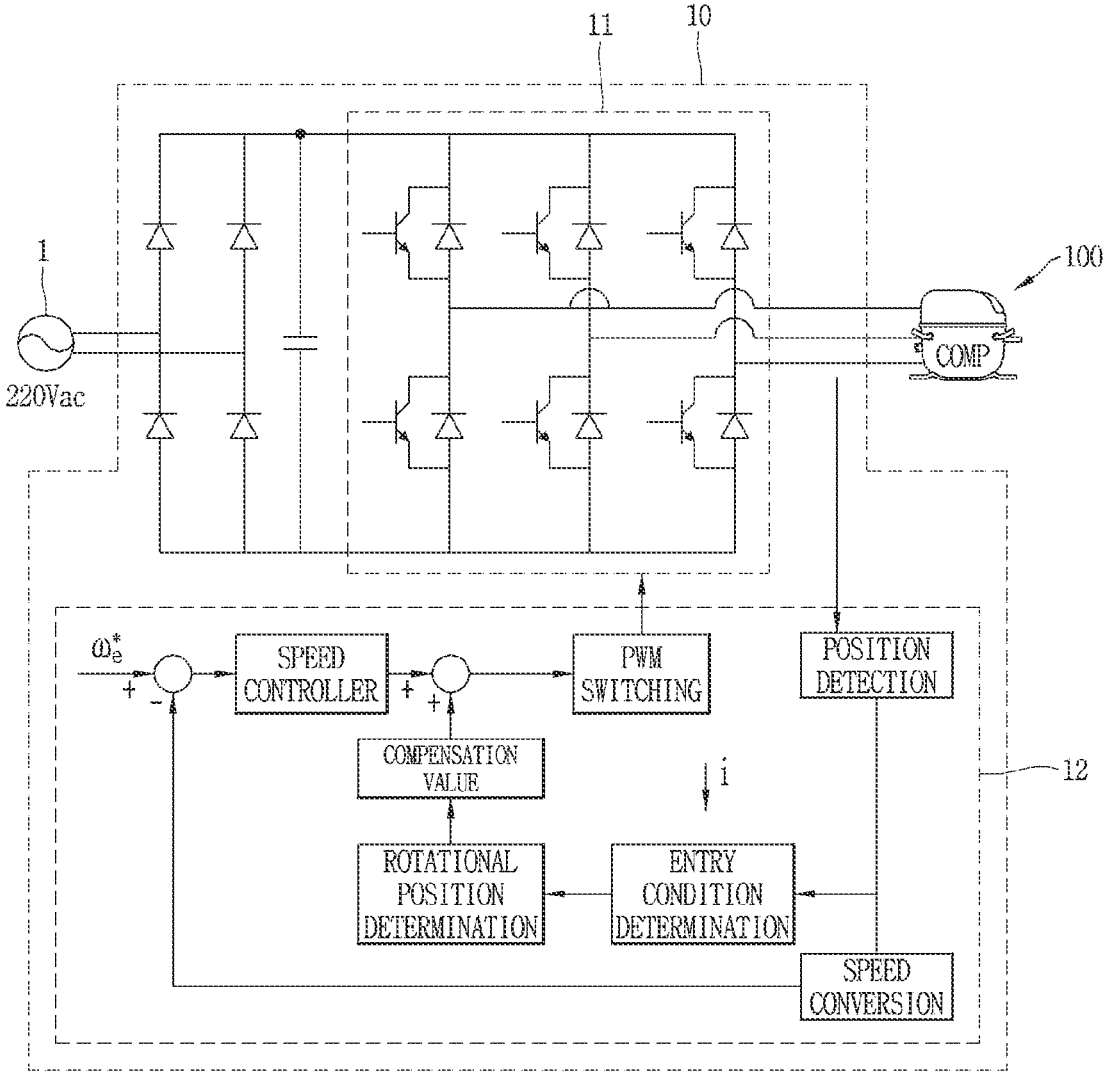
FIG. 4 is a detailed exemplary view of a compressor control apparatus illustrated in FIG. 3.

A specific circuit diagram of the control apparatus 10 as shown in FIG. 3 may be as shown in FIG. 4.

In the control apparatus 10, the inverter unit 11 converts power input from an external power source 1 into driving power for driving the motor of the compressor 100 to apply the converted driving power to the motor.

The inverter unit 11 may be connected to the motor to convert AC power input from the external power source 1 into DC power, and convert the DC power into the driving power so as to output the converted driving power to the motor.

Here, the motor may be a three-phase motor that drives the compressor C, and the driving power may be in the form of three-phase AC power.

The inverter unit 11 may convert the DC power into the driving power in the form of the AC power through the switching operation and output the converted driving power to the motor.

The inverter unit 11 may include a plurality of switching modules that convert the DC power into three-phase AC power.

The plurality of switching modules may be preferably insulated gate bipolar transistor (IGBT) modules.

The switching operation of the plurality of switching modules may be controlled by the control unit 12.

In other words, the inverter unit 11 may be controlled by the control unit 12.

The plurality of switching modules may receive a control signal for the switching operation from the control unit 12 to perform a switching operation and convert the DC power to the AC power according to the control signal.

In other words, the switching operation of the inverter unit 11 may controlled by the control unit 12, and the driving power may be controlled by the switching operation, thereby controlling the driving of the motor.

In the control apparatus 10, the control unit 12 detects at least one of a level of the driving power, a position of the piston of the compressor 100, and an internal pressure of the cylinder in which a reciprocating movement of the piston is carried out, and generates a pulse width modulation (PWM) control signal for controlling the switching operation of the inverter unit 11 based on the detection result, and applies the control signal to the inverter unit 11 to control the switching operation.

Here, the control signal is a pulse width modulation (PWM) control signal, and refers to a signal that adjusts a duty ratio of the switching module to control the switching operation.

In other words, the control unit 12 may control the switching operation in a PWM control method.

The control unit 12 may adjust the duty ratio of the control signal to control a current applied to the motor.

The control unit 12 may generate a control command based on the detection result to determine at least one of a command voltage for a voltage of the motor, a command current for a current of the motor, a speed command for an operating speed of the motor, and a frequency command for a switching frequency of the motor according to the control command, thereby generating the control signal according to the determination result.

Accordingly, feedback control of the compressor 100 may be performed.

The control unit 12 may determine an operation period of the compressor 100 or a stroke of the compressor 100 based on the detection result, and generate the control signal based on the determination result.

For instance, the control unit 12 may determine that the compressor 100 is performing a compression stroke based on a change in the internal pressure, thereby generating the control signal to allow a corresponding control to be carried out during the compression stroke.

The control unit 12 may include a plurality of controllers, to generate the control signal through a calculation process in the plurality of controllers.

For instance, as shown in FIG. 4, the control unit 12 may include at least one of a position detector, an entry condition determiner, a rotational position determiner, a speed converter, a speed controller, a compensation value calculator, and a PWM switching signal generator to generate the control command through calculation at each of the plurality of controllers so as to generate the control signal.

As such, the control unit 12 generates the control signal by differently compensating for a duty ratio of the control signal when the compressor 100 performs a compression stroke and a suction stroke, respectively.

In other words, the control unit 12 may generate the control signal by varying the compensation of the duty ratio according to a stroke performed by the compressor 100.

Accordingly, the compensation of the duty ratio when the compression stroke is performed and the compensation of the duty ratio when the suction stroke is performed may be carried out differently.

Here, the compression stroke and the suction stroke may refer to stroke periods divided according to the operation mechanism characteristics of the compressor 100.

Accordingly, the control apparatus 10 may vary the compensation of the duty ratio for each stroke period of the compressor 100 divided according to the characteristics of the operation mechanism.

Figure 5:
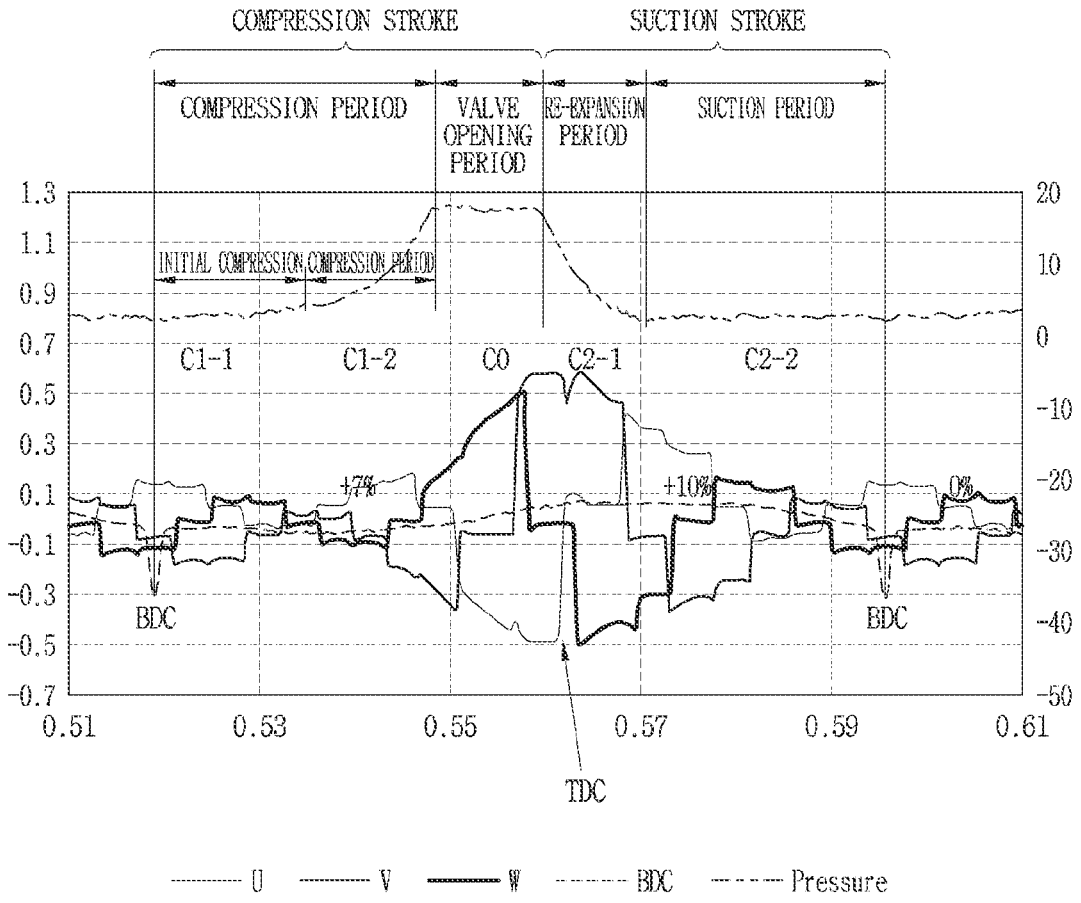
FIG. 5 is an exemplary view 1 for explaining an example of applying compensation for each stroke period according to an embodiment.

Each period of the compression stroke and the suction stroke in which the compensation of the duty ratio is carried out differently may be as shown in FIG. 5.

The compression stroke, which is a period in which the piston advances from the bottom dead center (BDC) to the top dead center (TDC) to carry out the compression of air so as to increase the internal pressure of the cylinder to a reference value, may include a compression period (C1-1 and C1-2) and a valve opening period (C0).

The suction stroke, which is a period in which compressed air is discharged, the piston moves backward from top dead center (TDC) to bottom dead center (BDC), and air is sucked to reduce the internal pressure to a reference value, may include a re-expansion period (C2-1) and a suction period (C2-2). In some cases, the top dead center (TDC) may refer to a front end portion of the cylinder or a time point when the piston is positioned at the front end portion of the cylinder. The valve assembly 141 may be disposed at the front end portion of the cylinder. The bottom dead center (BDC) may refer to a rear end portion of the cylinder or a time point when the piston is positioned at the rear end portion of the cylinder.

The control unit 12 may determine a current stroke period of the compressor 100 based on a detection result of at least one of the level of the driving power, the position, and the internal pressure, and compensate the duty ratio according to the determined stroke period to generate the control signal.

For instance, the current stroke period may be determined based on the detection result of at least one of the level and the internal pressure using a change of current or a change of internal pressure for each period as shown in FIG. 5.

In FIG. 5, a left vertical axis may indicate an RMS ratio value of current, and a right vertical axis may indicate a value of internal pressure.

Figure 6:
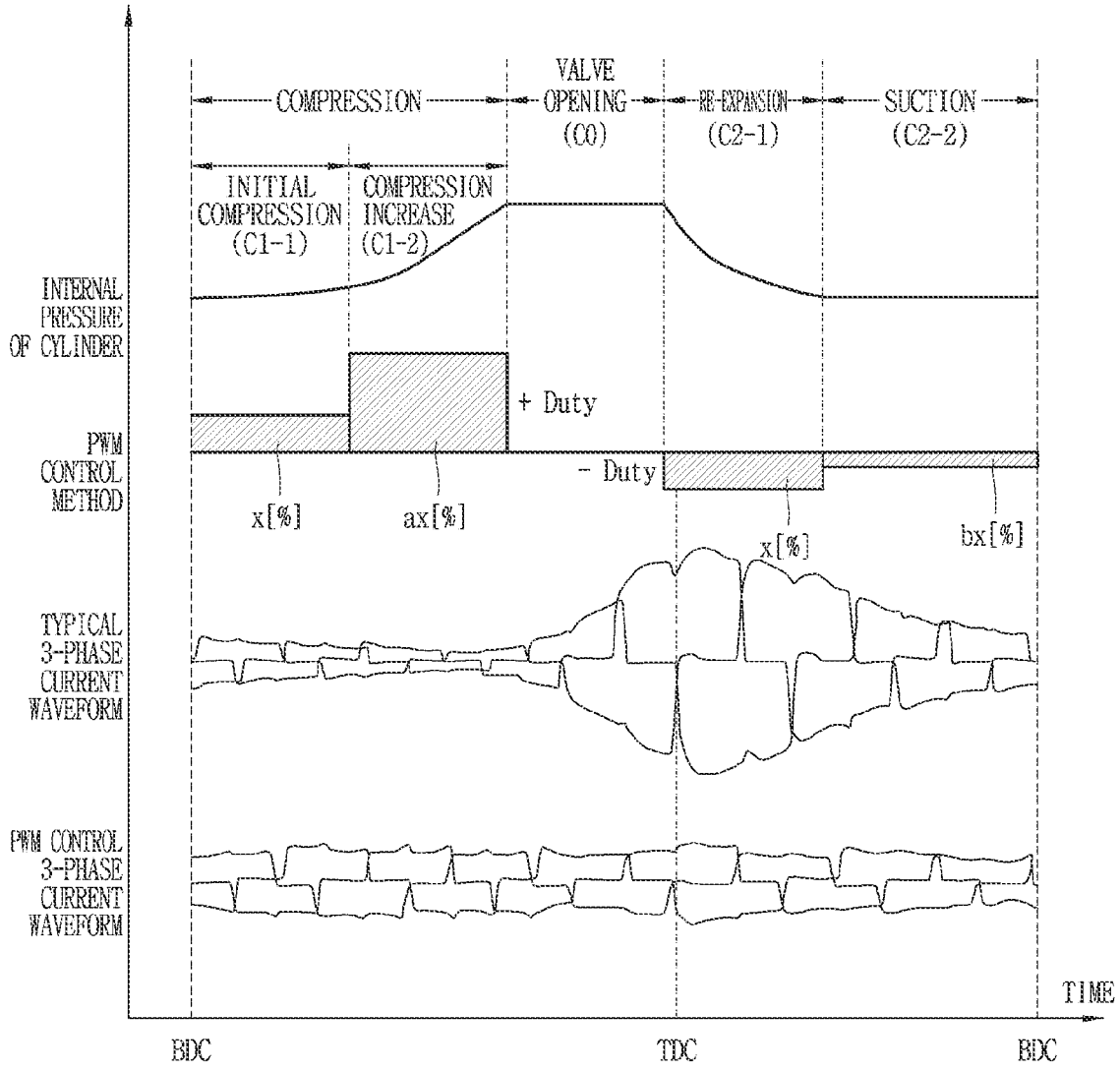
FIG. 6 is an exemplary view 2 for explaining an example of applying compensation for each stroke period according to an embodiment.

Compensation for each stroke period of the duty ratio may be carried out as shown in FIG. 6.

The control unit 12 may positively (+) compensate the duty ratio of the control signal during a first preset period (C1-1 and C1-2) while performing the compression stroke to generate the control signal.

Here, compensating the duty ratio during the first period (C1-1 and C1-2) may denote compensating the duty ratio during least part of the first period (C1-1 and C1-2).

Also in the following description, compensating the duty ratio during any period may denote compensating the duty ratio during at least part of the any period.

The first period (C1-1 and C1-2) may be at least part of a compression period during the compression stroke.

The first period (C1-1 and C1-2) may be a period from a time point at which the piston is positioned at the bottom dead center to a time point at which a valve of the cylinder is opened.

In other words, the control unit 12 may compensate a positive (+) compensation value for the duty ratio to generate the control signal during the first period (C1-1 and C1-2) from a time point at which the piston is positioned at the bottom dead center to a time point at which a valve of the cylinder is opened.

As shown in FIG. 6, the control unit 12 may generate the control signal while increasing the compensation value of the duty ratio during the first period (C1-1 and C1-2) step by step.

In other words, compensation may be increased step by step for the duty ratio during the first period (C1-1 and C1-2).

For instance, any compensation value may be compensated during a period 1-1 (C1-1), and a compensation value greater than the any compensation value may be compensated during a period 1-2 (C1-2) to increase the compensation step by step.

The control unit 12 may compensate a compensation value 1-1 x[%] for the duty ratio during the period 1-1 (C1-1) from a time point at which the piston is positioned at the bottom dead center to a time point at which the piston is moved to a specific position.

The period 1-1 (C1-1) may be an initial compression period of the compression stroke.

In other words, the control unit 12 may compensate the compensation value 1-1 x[%] for the duty ratio during the period 1-1 (C1-1) that corresponds to the initial compression period from a time point at which the piston is positioned at the bottom dead center to a time point at which the piston is moved to a specific position.

The control unit 12 may compensate a compensation value 1-2 ax[%] greater than the predetermined compensation value for the duty ratio during the period 1-2 (C1-2) from a time point at which the piston is positioned at the specific position to a time point at which the valve of the cylinder is opened during the first period (C1-1 and C1-2).

The period 1-2 (C1-2) may be a compression increase period during the compression stroke.

In other words, the control unit 12 may compensate the compensation value 1-2 ax[%] greater than the compensation value 1-1 x[%] for the duty ratio during the period 1-2 (C1-2) that corresponds to the compression increase period from a time point at which the piston is positioned at the specific position to a time point at which the valve of the cylinder is opened.

Here, the compensation value 1-1 x[%] may be a numerical value x[%] representing a compensation value of the duty ratio.

For example, the compensation value 1-1 x[%] may be 50[%].

The compensation value 1-2 ax[%] may be a predetermined multiple (a) of the compensation value 1-1 x[%].

For example, the compensation value 1-2 ax[%] may be 100[%], which is twice the compensation value 1-1 x[%].

Accordingly, the compensation of the duty ratio in the compression increase period (C1-2) may be increased by a predetermined multiple (a) than that of the initial compression period (C1-1), thereby increasing the compensation of the duty ratio during the compression stroke period step by step.

The control unit 12 may negatively (—) compensate the duty ratio of the control signal during a preset second period (C2-1) while performing the suction stroke to generate the control signal.

The second period (C2-1 and C2-2) may be at least part of the suction stroke period.

The second period (C2-1 and C2-2) may include at least part of the re-expansion period during the suction stroke.

The second period (C2-1 and C2-2) may include a period (C2-1) from a time point prior to a time point at which the piston is positioned at the top dead center by a predetermined time period to a time point at which the discharge of compressed air from the cylinder is ended.

In other words, the control unit 12 may compensate a negative (−) compensation value for the duty ratio during the period (C2-1) from a time point prior to a time point at which the piston is positioned at the top dead center by a predetermined time period to a time point at which the discharge of compressed air from the cylinder is ended.

Here, a period from a time point prior to a time point at which the piston is positioned at the top dead center by a predetermined time period to a time point at which the discharge of compressed air from the cylinder is ended may be the re-expansion period (C2-1).

Accordingly, the control unit 12 may compensate a negative (−) compensation value for the duty ratio to generate the control signal during the re-expansion period (C2-1).

Here, the re-expansion period (C2-1) may include a period in which the piston moves backward by residual gas that has not been discharged.

In other words, during the re-expansion period (C2-1) from a time point prior to a time point at which the piston is positioned at the top dead center by a predetermined time period to a time point at which the discharge of compressed air from the cylinder is ended, backward movement may be carried out by the re-expansion of undischarged residual gas.

As shown in FIG. 6, the control unit 12 may compensate a second compensation value x[%] for the duty ratio during the second period (C2-1 and C2-2).

Here, the second compensation value x[%] is a negative (−) compensation value, but may be the same numerical value as the compensation value 1-1 x[%].

For example, when the first compensation value x[%] is 50[%], the second compensation value x[%] may be 50[%].

Accordingly, during the second period (C2-1 and C2-2), negative compensation may be carried out as much as the positive compensation value during the initial compression period (C1-1).

The second period (C2-1 and C2-2) may also further include a period (C2-2) from a time point at which the discharge of compressed air from the cylinder is ended to a time point at which the piston is positioned at the bottom dead center.

For instance, at least part of the suction period during the suction stroke may be further included.

In this case, the second period (C2-1 and C2-2) may be divided into the re-expansion period (C2-1) corresponding to the period 2-1 and the suction period (C2-2) corresponding to the period 2-2, and the compensation of the duty ratio may also be carried out in the suction period (C2-2).

For instance, a compensation value 2-2 bx[%] may be compensated for the duty ratio during the suction period (C2-2).

On the other hand, when the second period (C2-1 and C2-2) includes the period 2-2 (C2-2), the control unit 12 may generate the control signal by decreasing the compensation value of the duty ratio even during the second period (C2-1 and C2-2) step by step.

For instance, any compensation value may be compensated during the period 2-1 (C2-1), and a compensation value smaller than the any compensation value may be compensated during the period 2-2 (C2-2) to increase the compensation step by step.

In this case, since negative (−) compensation is carried out during the second period (C2-1 and C2-2), reduction of the compensation value, which is an absolute value, may denote an increase in the compensation as a result.

As such, the control unit 12 that positively (+) compensates for the duty ratio during the compression stroke, and negatively (—) compensates for the duty ratio during the suction stroke to vary the compensation of the duty ratio for each stroke period may differently compensate for the duty ratios during the compression stroke and the suction stroke when the compressor 100 operates at an operating frequency below a preset reference frequency.

In other words, when the compressor 100 operates at the reference frequency or less, the control unit 12 may compensate for the duty ratio during the compression stroke and the duty ratio during the suction stroke to be different from each other.

Here, the reference frequency may be a frequency corresponding to a low-speed operation region.

The reference frequency may also be set to an operating speed of the compressor 100.

Accordingly, compensation may be varied during the compression stroke and the suction stroke when the compressor 100 operates at a reference speed or less.

<Compressor>

Hereinafter, an embodiment of the compressor will be described.

The compressor 100 includes a piston that performs a reciprocating movement by a rotation of a motor, a cylinder in which the reciprocating movement of the piston is carried out, a valve that controls the air inflow and outflow of the cylinder, and the control apparatus 10 that controls the application of the driving power according to at least one of a level of driving power applied to the motor, a position of the piston, and an internal pressure of the cylinder to control the operation of the compressor 100.

Here, the control apparatus 10 may be the control apparatus as described above.

The control apparatus 10 may also be an apparatus different from the control apparatus described above.

Hereinafter, a portion overlapping the above description will be omitted, and a specific embodiment of the compressor 100 will be mainly described.

When the operating speed of the compressor 100 is a preset reference speed or less, the control apparatus 10 in the compressor 100 controls the operation of the compressor 100 by varying the compensation of a current applied to the motor for each of a plurality of stroke periods divided according to a change of the internal pressure.

In other words, when the compressor 100 operates at the reference speed or less, the control apparatus 10 may differently compensate the current for each of the plurality of stroke periods to control the operation of the compressor 100.

Here, the reference speed may be a speed corresponding to a low-speed operation region.

The reference speed may also be set to an operating frequency of the compressor 100.

For instance, the reference speed may be set to 15 [Hz].

In this case, when the compressor 100 is operating at a speed of 15 [Hz] or less, the control apparatus 10 may differently compensate the current for each of the plurality of stroke periods to control the operation of the compressor 100.

The control apparatus 10 may detect at least one of a level of the driving power, the position, and the internal pressure to determine a stroke period currently being performed based on the detection result, and compensate a current compensation value according to the determined stroke period to control the operation of the compressor 100.

For instance, the stroke period currently being performed may be determined based on a change of the internal pressure among the plurality of stroke periods.

As shown in FIG. 6, the plurality of stroke periods may be divided according to a change of the internal pressure to include the initial compression period (C1-1) in which the internal pressure increases to a preset reference level, the compression increase period (C1-2) in which the internal pressure increases by more than a preset increase rate, the valve opening period (C0) in which the internal pressure changes within a preset rising range, the re-expansion period (C2-1) in which the internal pressure decreases by more than a preset decrease rate, and the suction period (C2-2) in which the internal pressure varies within a preset minimum range.

In other words, the control apparatus 10 may determine the stroke period currently being performed among the compression initial period (C1-1), the compression increase period (C1-2), the valve opening period (C0), the re-expansion period (C2-1) and the suction period (C2-2).

In the embodiment of the compressor 100, the control apparatus 10 may preferably determine that stroke period currently being performed is any one of the compression initial period (C1-1), the compression increase period (C1-2), the valve opening period (C0), the re-expansion period (C2-1) and the suction period (C2-2).

The initial compression period (C1-1) may be a period in which the internal pressure increases from a level when the piston is positioned at the bottom dead center (BDC) to the reference level.

The reference level may be a level when the internal pressure starts to increase by more than the increase rate.

In other words, the initial compression period (C1-1) may be a period in which the internal pressure increases from a level when the piston is positioned at the bottom dead center (BDC) to the reference level.

Accordingly, when the control apparatus 10 detects an internal pressure level when the piston is positioned at the bottom dead center (BDC), it is determined that the compressor 100 has entered the initial compression period (C1-1).

The compression increase period (C1-2) may be a period in which the internal pressure increases by more than the increase rate from the reference level.

The increase rate may be a predetermined differential value of the internal pressure.

In other words, the compression increase period (C1-2) may be a period in which the internal pressure increases with a slope above a predetermined differential value from the reference level.

Accordingly, the control apparatus 10 may determine that the compressor 100 has entered the compression increase period (C1-2) when the internal pressure level of the reference level is detected.

The valve opening period (C0) may be a period in which the internal pressure changes within the rising range from the level after increasing by more than the increase rate.

The rising range may be a change range of the maximum value of the internal pressure.

In other words, the valve opening period (C0) may be a period in which the internal pressure changes within a change range of the maximum value of the internal pressure from the level after increasing by more than the increase rate.

Accordingly, the control apparatus 10 may determine that the compressor 100 has entered the valve opening period (C0) when detecting an internal pressure level after increasing by more than the increase rate.

Alternatively, it may be determined that the compressor 100 has entered the valve opening period (C0) by detecting the opening state of the valve.

The re-expansion period (C2-1) may be a period in which the internal pressure decreases by more than the decrease rate from the level after changing within the rising range.

The decrease rate may be a predetermined differential value of the internal pressure.

In other words, the re-expansion period (C2-1) may be a period in which the internal pressure decreases with a slope above a predetermined differential value from the level after changing within the rising range.

Accordingly, the control apparatus 10 may determine that the compressor 100 has entered the re-expansion period (C2-1) when detecting an internal pressure level after the internal pressure changes within the rising range.

The suction period (C2-2) may be a period in which the internal pressure changes within the minimum range from the level after decreasing by mote then the decrease rate.

The minimum range may be a change range of the minimum value of the internal pressure.

In other words, the suction period (C2-2) may be a period in which the internal pressure changes within a change range of the minimum value of the internal pressure from the level after decreasing by more than the decrease rate.

Accordingly, the control apparatus 10 may determine that the compressor 100 has entered the suction period (C2-2) when detecting the internal pressure level after decreasing by more than the decrease rate.

As such, the control apparatus 10 that determines a current stroke period may compensate a different current compensation value for the current for each of the plurality of stroke periods to control the operation of the compressor 100.

Here, the compensation of the current denotes compensating a current compensation value to a control command that is a basis for generation of a control signal for controlling the current to generate the control signal according to the control command reflecting the current compensation value, thereby controlling the compensation of the current.

Alternatively, the compensation of the current may denote reflecting a duty ratio compensation value corresponding to a current compensation value for a duty ratio of a control signal to control the compensation of the current through the control signal on which the current compensation value is reflected.

The control apparatus 10 may compensate a compensation value of 50[%] for the current during the initial compression period (C1-1).

In other words, when the current stroke period is the initial compression period (C1-1), the control apparatus 10 may compensate the compensation value of 50[%] for the current.

The control apparatus 10 may compensate for the current during the compression increase period (C1-2) by increasing the compensation value compared to the initial compression period (C1-1).

In other words, when the current stroke period is the compression increase period (C1-2), the control apparatus 10 may compensate for the current with an increased compensation value than the initial compression period (C1-1).

For example, when the compensation value of 50[%] is compensated for the current during the initial compression period (C1-1), a compensation value of 100[%] may be compensated for the current during the compression increase period (C1-2).

Accordingly, the control apparatus 10 may control the compensation of the current to increase from the initial compression period (C1-1) to the compression increase period (C1-2) step by step.

The control apparatus 10 may not compensate for the current during the valve opening period (C0).

In other words, when the current stroke period is the valve opening period (C0), the control apparatus 10 may not compensate for the current.

The control apparatus 10 may compensate a compensation value of −50[%] for the current during the re-expansion period (C2-1).

In other words, when the current stroke period is the re-expansion period (C2-1), the control apparatus 10 may compensate the compensation value of −50[%] for the current.

The control apparatus 10 may compensate for the current by decreasing a compensation value for the current during the suction period (C2-2) than during the re-expansion period (C2-1).

Here, a decrease of the compensation value may denote a decrease of an absolute value.

In other words, when the current stroke period is the suction period (C2-2), the control apparatus 10 may compensate for the current with a compensation value in which the absolute value is decreased compared to the re-expansion period (C2-1).

For example, when the compensation value of −50[%] is compensated for the current during the re-expansion period (C2-1), a compensation value of −25[%] may be compensated for the current during the suction period (C2-2).

In other words, the control apparatus 10 may control the compensation of the current to increase step by step from the re-expansion period (C2-1) to the suction period (C2-2).

Figure 7:
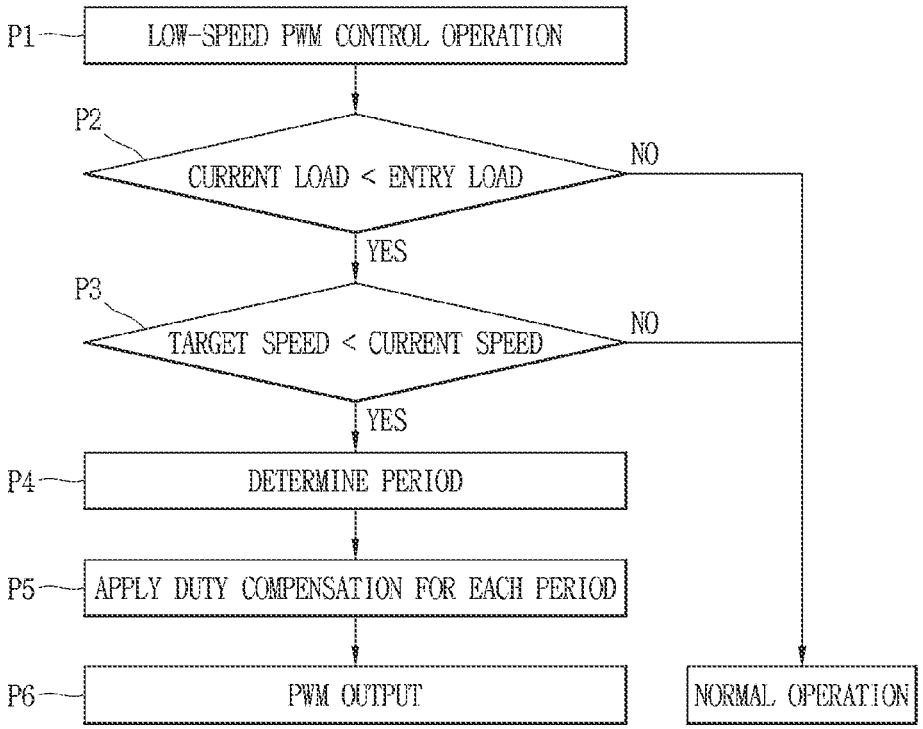
FIG. 7 is a flowchart showing a compressor operation control process according to an embodiment.

An example of a process in which the control apparatus 10 controls the operation of the compressor 100 may be as shown in FIG. 7.

When the operation of the compressor 100 starts, the control apparatus 10 may control the compressor 100 with a low-speed operation (P1), determine whether a current load is less than an entry load (P2) to switch to a normal operation when the current load is above the entry load, determine whether a target speed is less than a current speed (P3) when the current load is less than the entry load to switch to a normal operation when the target speed is above the current speed, and determine the current stroke period (P4) based on a result of detecting at least one of a magnitude of the driving power, the position, and the internal pressure when the target speed is less than the current speed.

Then, when a period corresponding to the current stroke is determined among the plurality of stroke periods, a compensation value according to the determined current stroke period may be applied to a duty ratio of the control signal (P5) to output a control signal to which the compensation value is applied to the motor (P6).

<Compressor Control Method>

Hereinafter, an embodiment of a compressor control method (hereinafter, referred to as a control method) will be described.

The control method may be a method in which the foregoing control apparatus 10 controls the compressor 100.

The control method may also be a method in which the foregoing control unit 12 of the control apparatus 10 controls the compressor 100.

The control method may also be a control method of an apparatus different from the foregoing control apparatus.

Hereinafter, a portion overlapping with the foregoing description will be omitted, and a specific embodiment of the control method will be mainly described, but the specific embodiment of the control method will be mainly described on the embodiment in which the foregoing control apparatus 10 controls the compressor 100.

Figure 8:
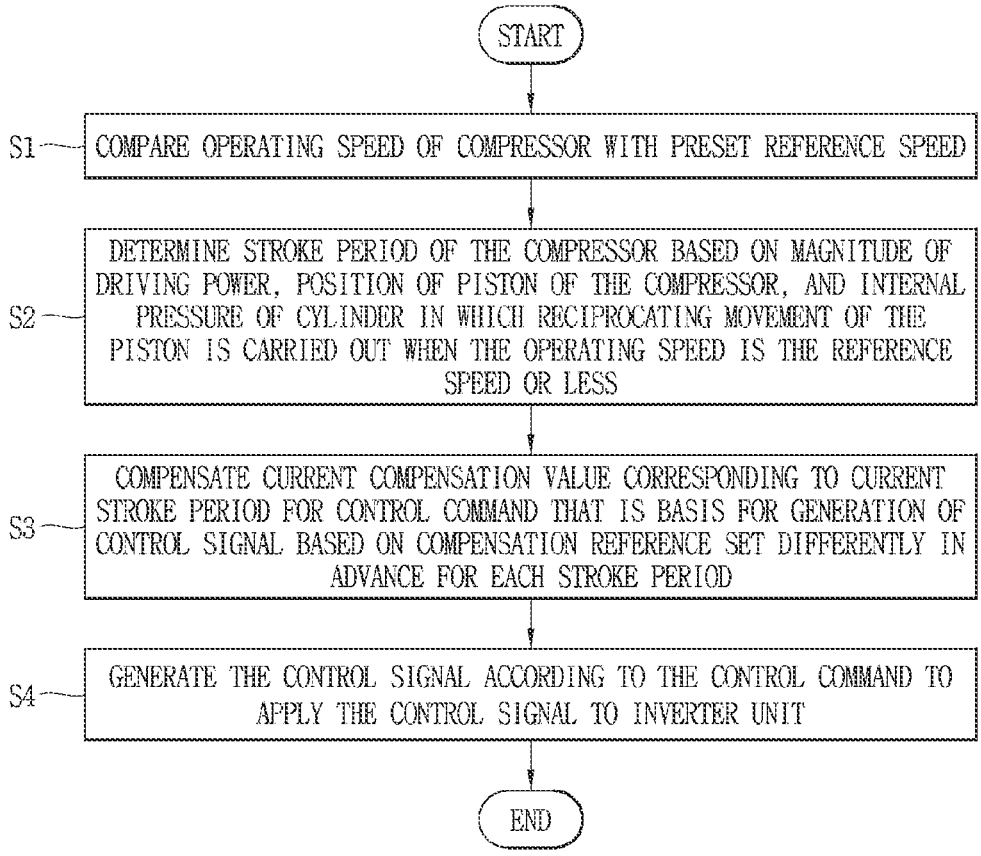
FIG. 8 is a flowchart 1 of a compressor control method according to an embodiment.

The control method is a compressor control method of the control apparatus 10 as shown in FIGS. 3 and 4, and includes a step S1 of comparing an operating speed of the compressor 100 with a preset reference speed, a step S2 of determining a stroke period of the compressor 100 based on at least one of a magnitude of the driving power, a position of the piston of the compressor, and an internal pressure of the cylinder in which the reciprocating movement of the piston is carried out when the operating speed is the reference speed or less, a step S3 of compensating a current compensation value corresponding to a current stroke period for a control command that is a basis for the generation of the control signal based on a compensation reference set differently in advance for each stroke period, and a step S4 of generating the control signal according to the control command to apply the control signal to the inverter unit 11, as shown in FIG. 8.

In other words, the control method may control the operation of the compressor 100 in the order of determining the stroke period when the compressor 100 is operating at the reference speed or less (S2) as a result of determining, by the compressor 100, the operating speed of the compressor 100 (S1), compensating a current compensation value corresponding to the current stroke period according to the compensation reference (S3), and generating the control signal according to the control command for which the current compensation value is compensated to apply the control signal to the inverter unit 11.

The step S2 of determining the stroke period of the compressor 100 may be detecting, by the control apparatus 10, at least one of a magnitude of the driving power, the position, and the internal pressure to determine the stroke period based on the detection result.

As shown in FIG. 6, the stroke period may include the initial compression period (C1-1) in which the internal pressure increases to a preset reference level, the compression increase period (C1-2) in which the internal pressure increases by more than a preset increase rate, the valve opening period (C0) in which the internal pressure changes within a preset rising range, the re-expansion period (C2-1) in which the internal pressure decreases by more than a preset decrease rate, and the suction period (C2-2) in which the internal pressure varies within a preset minimum range.

Accordingly, the control apparatus 10 may determine that the current stroke period is which one of the initial compression period (C1-1), the compression increase period (C1-2), the valve opening period (C0), the re-expansion period (C2-1), and the suction period (C2-2) in the step S2 of determining the stroke period.

The step S3 of compensating the current compensation value for a control command that is a basis for the generation of the control signal may be compensating, by the control apparatus 10, a current compensation value according to the current stroke period for the control command based on the compensation reference.

For the compensation reference, the current compensation value may be set to a positive (+) compensation value during the initial compression period (C1-1) and the compression increase period (C1-2), and the current compensation value may be set to a negative (−) compensation value during the re-expansion period (C2-1).

Accordingly, when it is determined that the current stroke period is the initial compression period (C1-1) or the compression increase period (C1-2) in the step S2 of determining the stroke period, the control apparatus 10 may compensate a positive (+) compensation value for the control command in the step S3 of compensating the control command, and when it is determined that the current stroke period is the re-expansion period (C2-1) in the step S2 of determining the stroke period, the control apparatus 10 may compensate a negative (−) compensation value for the control command in the step S3 of compensating the control command.

In addition, when it is determined that the current stroke period is the valve opening period (C0) in the step S2 of determining the stroke period, the control apparatus 10 may not compensate a compensation value for the control command in the step S3 of compensating for the control command.

In other words, the control apparatus 10 may not compensate the compensation value during the valve opening period (C0).

The compensation reference may also be set differently for each of the stroke periods.

For instance, a compensation value +x[%] may be set during the initial compression period (C1-1), a compensation value ax[%] greater than the compensation value +x[%] of the initial compression period (C1-1) may be set during the compression increase period (C1-2), a compensation value −x[%] may be set during the re-expansion period (C2-1), and a compensation value −bx[%] greater than the compensation value −x[%] of the re-expansion period (C2-1) (having a larger absolute value) may be set during the suction period (C2-2).

Here, the compensation value +ax[%] of the compression increase period (C1-2) may be set to a compensation value that is increased step by step than the compensation value +x[%] of the initial compression period (C1-1).

For instance, it may be set to ax[%], which is a predetermined multiple (a: a number greater than or equal to 2) of the compensation value +x[%] of the initial compression period (C1-1).

Furthermore, the compensation value −bx[%] of the suction period (C2-2) may be set to a compensation value that is increased step by step than the compensation value −x[%] of the re-expansion period (C2-1).

For instance, the compensation value −x[%] of the re-expansion period (C2-1) may be set to −bx[%], which is a predetermined rate (b: a number greater than 0 and less than 1).

In addition, the compensation value +x[%] of the initial compression period (C1-1) and the compensation value −x[%] of the re-expansion period (C2-1) may be set to have the same absolute value.

By setting the compensation references as described above, the compensation value may be increased step by step from the initial compression period (C1-1) to the compression increase period (C1-2), and the compensation value may be increased step by step from the re-expansion period (C2-1) to the suction period (C2-2).

As such, the compensation value may be increased and compensated step by step, thereby stably changing the current control and limiting a sudden change in the current corresponding to the load.

In a case where the compensation reference is set as described above, in the step S3 of compensating for the control command, the control apparatus 10 may compensate a compensation value x[%] of the initial compression period (C1-1) for the control command when it is determined that the current stroke period is the initial compression period (C1-1) in the step S2 of determining the stroke period, compensate a compensation value +ax[%] of the compression increase period (C1-2) for the control command when it is determined that the current stroke period is the compressing increase period (C1-2) in the step S2 of determining the stroke period, compensate a compensation value for the control command when it is determined that the current stroke period is the valve opening period (C0) in the step S2 of determining the stroke period, compensate a compensation value −x[%] of the re-expansion period (C2-1) for the control command when it is determined that the current stroke period is the re-expansion period (C2-1) in the step S2 of determining the stroke period, and compensate a compensation value −bx[%] of the suction period (C2-2) for the control command when it is determined that the current stroke period is the suction period (C2-2) in the step S2 of determining the stroke period.

In the step S4 of generating the control signal according to the control command to apply the generated control signal to the inverter unit 11, the control apparatus 10 may generate the control signal according to the control command that is compensated according to the compensation reference to apply the generated control signal to the inverter unit 11, thereby controlling the current according to the compensation of the current compensation value.

In a case where the operation of the compressor 100 is continuously controlled, the control apparatus 10 may repeatedly perform steps subsequent to the step S1 of comparing the operating speed of the compressor 100 with a preset reference speed after the step S4 of generating the control signal according to the control command to apply the generated control signal to the inverter unit 11.

Figure 9:
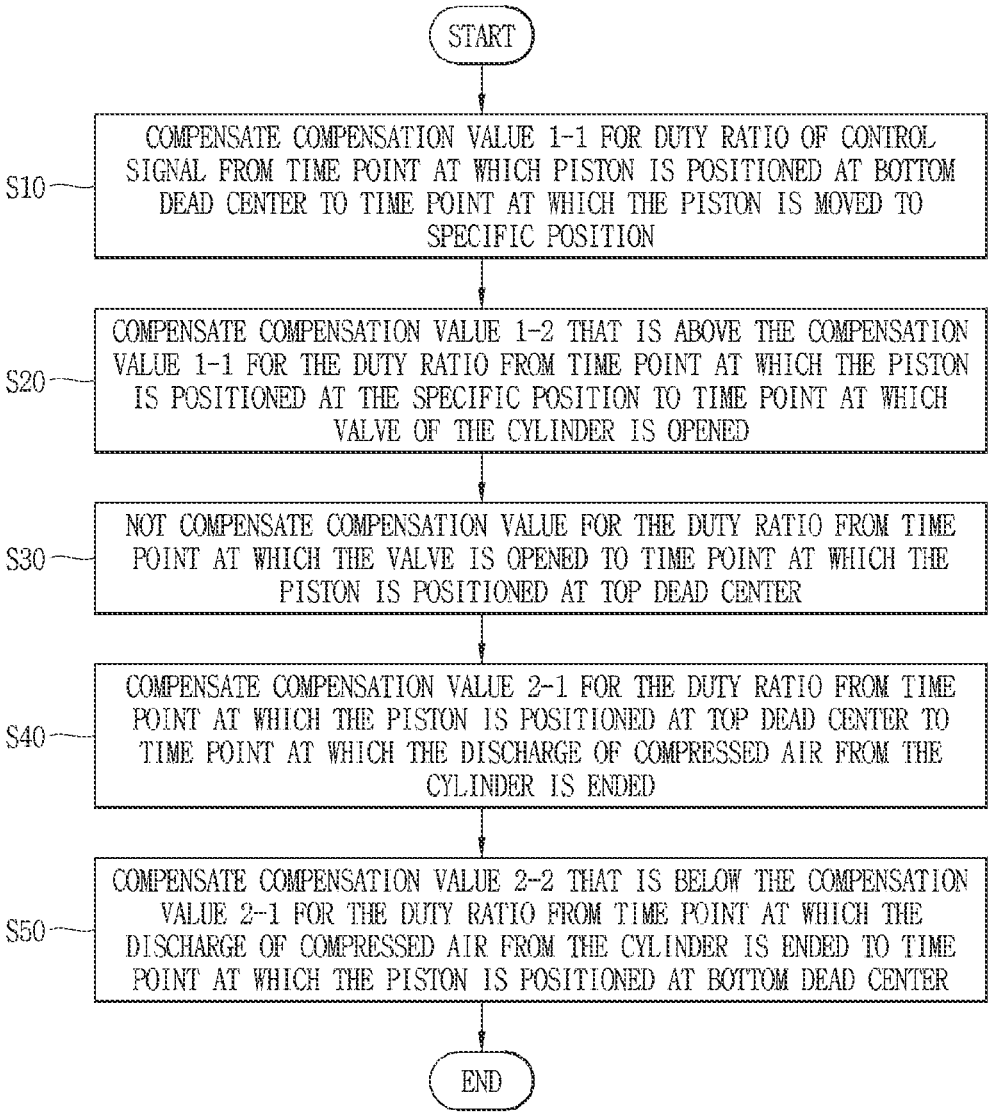
FIG. 9 is a flowchart 2 of a compressor control method according to an embodiment.

Meanwhile, the control method may also be implemented in the order as illustrated in FIG. 9.

In other words, another embodiment of the control method may be as shown in FIG. 9.

The control method as shown in FIG. 9 includes compensating a compensation value 1-1 for a duty ratio of the control signal from a time point at which the piston is positioned at the bottom dead center to a time point at which the piston is moved to a specific position (S10), compensating a compensation value 1-2 that is above the compensation value 1-1 for the duty ratio from a time point at which the piston is positioned at the specific position to a time point at which the valve of the cylinder is opened (S20), not compensating a compensation value for the duty ratio from a time point at which the valve is opened to a time point prior to a time point at which the piston is positioned at the top dead center by a predetermined time period (S30), compensating a compensation value 2-1 for the duty ratio from a time point prior to a time point at which the piston is positioned at the top dead center by a predetermined time period to a time point at which the discharge of compressed air from the cylinder is ended (S40), and compensating a compensation value 2-2 that is below the compensation value 2-1 for the duty ratio from a time point at which the discharge of compressed air from the cylinder is ended to a time point at which the piston is positioned at the bottom dead center (S50).

In other words, the control method may control the operation of the compressor 100 in the order of compensating the compensation value 1-1 for the duty ratio (S10), compensating the compensation value 1-2 that is above the compensation value 1-1 (S20), not compensating the compensation value (S30), compensating the compensation value 2-1 (S40), and compensating the compensation value 2-2 that is below the compensation value 2-1 (S50).

Accordingly, the control apparatus 10 may compensate the duty ratio with a different compensation value for each step to perform each step in order.

The step S10 of compensating the compensation value 1-1 (S10) may be a step corresponding to the foregoing initial compression period (C1-1), the step S20 of compensating the compensation value 1-2 (S20) may be a step corresponding to the foregoing compression increase period (C1-2), the step S30 of compensating the compensation value may be a step corresponding to the foregoing valve opening period (C0), the step S40 of compensating the compensation value 2-1 may be a step corresponding to the foregoing re-expansion period (C2-1), and the step S50 of compensating the compensation value 2-2 (S50) may be a step corresponding to the foregoing suction period (C2-2).

According to the control method as described above, the compressor 100 may operate in the order of the initial compression period (C1-1) (S10) in which the compensation value 1-1 is compensated for the duty ratio, the compression increase period (C1-2) (S20) in which the compensation value 1-2 is compensated for the duty ratio, the valve opening period (C0) (S30) in which the compensation value is not compensated for the duty ratio, the re-expansion period (C2-1) (S40) in which the compensation value 2-1 is compensated for the duty ratio, and the suction period (C2-2) (S50) in which the compensation value 2-2 is compensated for the duty ratio.

The embodiments of the control method described above can be implemented as computer-readable codes on a medium in which a program is recorded. The computer readable medium includes all types of recording devices in which data readable by a computer system is stored. Examples of the computer-readable medium include a hard disk drive (HDD), a solid state disk (SSD), a silicon disk drive (SDD), a ROM, a RAM, a CD-ROM, a magnetic tape, a floppy disk, an optical data storage device and the like, and may also be implemented in the form of a carrier wave (e.g., transmission over the Internet). In addition, the computer may also include the control apparatus 100.

The control method as described above may be applicable to a control algorithm and program including an application, software, and the like for controlling the control apparatus 100 or a motor of the control unit 12 included in the control apparatus 100.

Effect According to Embodiments

Hereinafter, effects according to the embodiments of the control apparatus 10, the compressor 100, and the control method described above will be described with reference to the drawings of experimental graphs.

Figure 10A:
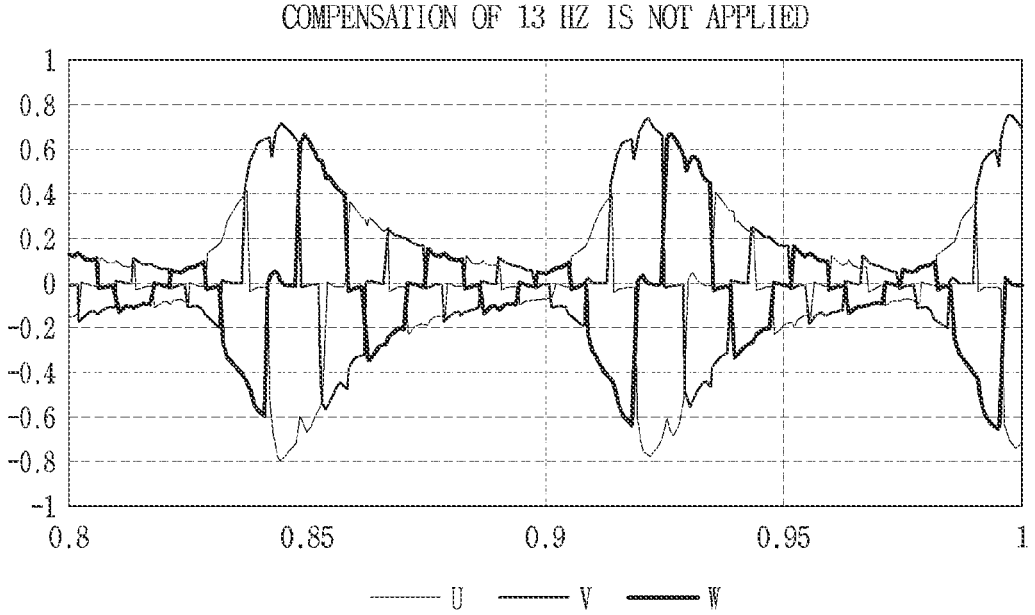
FIG. 10A is an exemplary view showing a change in current level when compensation is not applied.
Figure 10B:
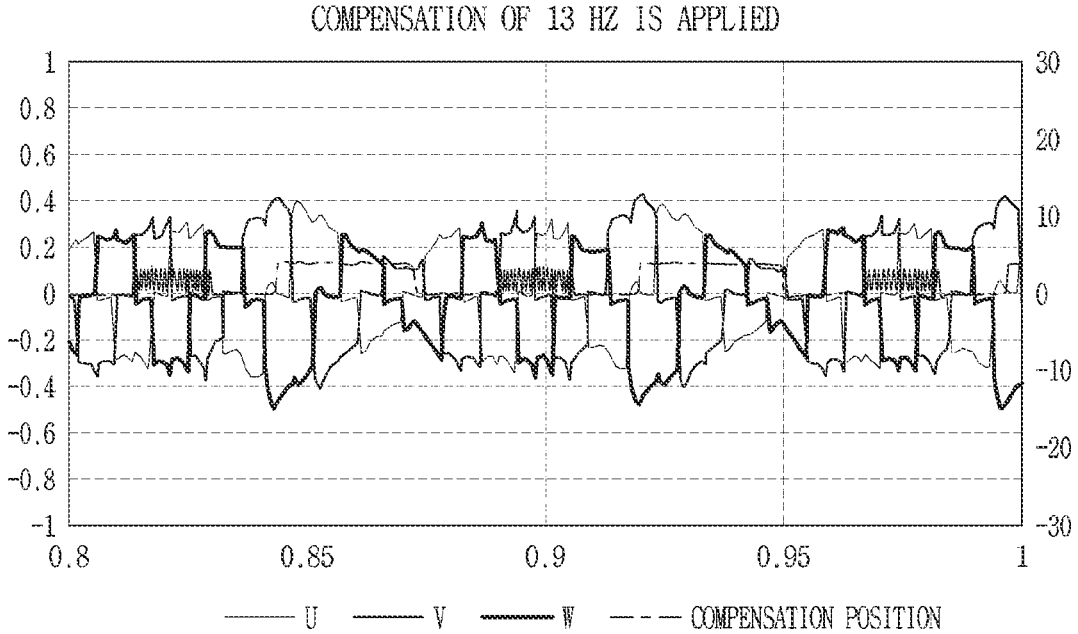
FIG. 10B is an exemplary view showing a change in current level when compensation is applied according to an embodiment.
Figure 11:
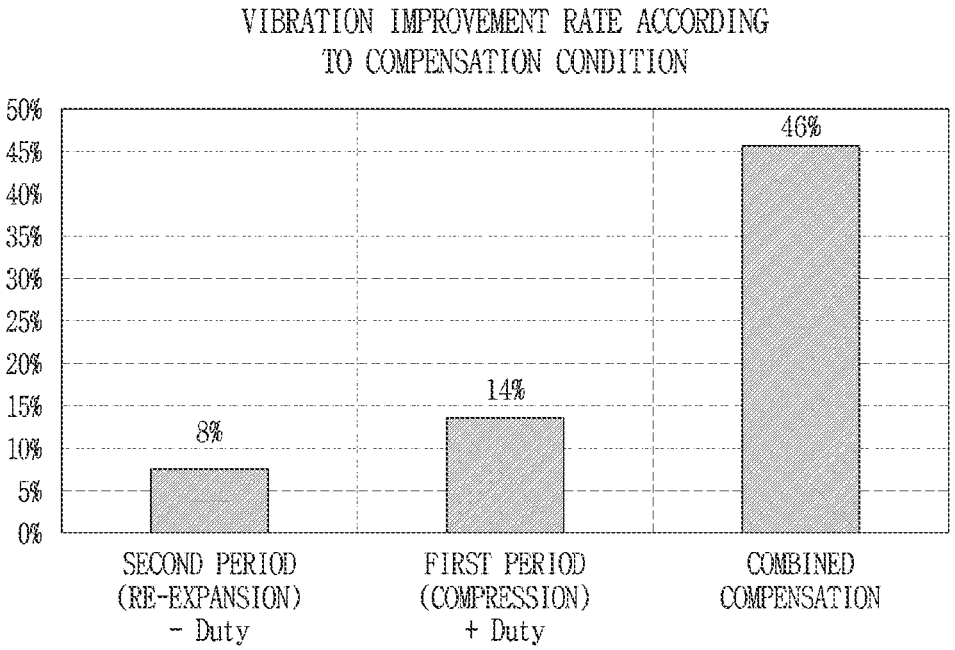
FIG. 11 is an exemplary view showing a vibration improvement rate when compensation is applied according to an embodiment.

FIGS. 10A and 10B are graphs of current change results of control without compensation when the operating frequency is 13 [Hz] and control (with compensation) according to the embodiments, respectively, and FIG. 11 is a graph of current change results of control without compensation when the operating frequency is 15 [Hz] and control (with compensation) according to the embodiments, respectively.

Comparing FIGS. 10A and 10B when the operating frequency is 13 [Hz], it can be seen that a level of the current is reduced by 21 to 27[%] compared to the control without compensation as a result of the control according to the embodiments.

As such, when the compensation control as in the embodiments is implemented in a low-speed operation region, a sudden change of the current is limited as well as a magnitude of the current is reduced to reduce the power consumption of the compressor during a low-speed operation, thereby increasing efficiency.

FIG. 11 shows a graph showing vibration improvement rates in a case where compensation control is implemented only during the compression stroke (first period—compression), in a case where compensation control is implemented only during the suction stroke (second period—re-expansion), and a case where compensation control with different compensation values is implemented during both the two strokes, respectively. As illustrated in FIG. 11, it can be seen that vibration is improved by 46[%] in the case where compensation control with different compensation values is implemented in both the two strokes, and the effect of improving the vibration is greater than those where compensation control is implemented only in either one period.

In particular, a result shown in FIG. 11 is a graph showing a result according to the embodiments, and it can be seen that there is a significant difference (46[%]) than simply adding the results of implementing compensation control during the first and second periods (14[%]+8[%]), respectively, thereby having an effect that cannot be predicted or expected from a configuration that simply combines compensation control during the first period and compensation control during the second period.

Although the present disclosure has been described with respect to specific embodiments and drawings, the present disclosure is not limited to those embodiments, and it will be apparent to those skilled in the art that various changes and modifications can be made from the description disclosed herein. Accordingly, the concept of the present disclosure should be construed in accordance with the appended claims, and all the same and equivalent changes will fall into the scope of the present disclosure.

What is claimed is:

1. A compressor control apparatus configured to control operation of a compressor, the compressor including a cylinder, a piston configured to reciprocate in the cylinder, and a motor configured to move the piston, the compressor control apparatus comprising:

an inverter configured to convert power received from an external power source into driving power for driving the motor of the compressor; and a controller configured to:

detect at least one of a magnitude of the driving power, a position of the piston of the compressor, or an internal pressure of the cylinder of the compressor, generate a pulse width modulation (PWM) control signal for controlling a switching operation of the inverter based on a result of detecting at least one of the magnitude of the driving power, the position of the piston of the compressor, or the internal pressure of the cylinder of the compressor, apply a compensation value to a duty ratio of the PWM control signal, the compensation value being varied based on the compressor performing a compression stroke or a suction stroke, and apply the PWM control signal to the inverter to control the switching operation of the inverter, wherein the controller is configured to:

decrease the compensation value during a first period of the suction stroke, apply a first compensation value to the duty ratio during a first period of the compression stroke, and apply a second compensation value to the duty ratio during the first period of the suction stroke, the second compensation value being different from the first compensation value.

2. The compressor control apparatus of claim 1, wherein the controller is configured to increase the compensation value during a compression period of the compression stroke.

3. The compressor control apparatus of claim 2, wherein the compression period is defined based on a period of time between (i) a time point at which the piston is positioned at a rear end of the cylinder and (ii) a time point at which a valve of the cylinder is opened.

4. The compressor control apparatus of claim 2, wherein the controller is configured to generate the PWM control signal while increasing the compensation value stepwise during the compression period.

5. The compressor control apparatus of claim 4, wherein the first period of the compression stroke is from a time point at which the piston is positioned at a rear end of the cylinder to a time point at which the piston is moved to an intermediate position, wherein the controller is configured to apply a compensation value to the duty ratio during a second period of the compression stroke, wherein the compensation value applied during the second period of the compression stroke is greater than the first compensation value applied during the first period of the compression stroke, and wherein the second period of the compression stroke is from the time point at which the piston is positioned at the intermediate position to a time point at which a valve of the cylinder is opened.

6. The compressor control apparatus of claim 5, wherein the first compensation value is 50%, and the compensation value applied during the second period of the compression stroke is a predetermined multiple of the first compensation value.

7. The compressor control apparatus of claim 1, wherein the first period of the suction stroke is defined based on a period of time between (i) a time point that is prior to a front end time point at which the piston is positioned at a front end of the cylinder by a predetermined time period and (ii) a time point at which discharge of compressed air from the cylinder is ended.

8. The compressor control apparatus of claim 1, wherein the second compensation value is-50%.

9. The compressor control apparatus of claim 1, wherein the controller is configured to:

compare an operating frequency of the compressor to a preset reference frequency; and based on the operating frequency of the compressor being less than the preset reference frequency, vary the compensation value corresponding to the compression stroke and the suction stroke.

10. A compressor, comprising:

a cylinder;

a piston disposed in the cylinder and configured to reciprocate in the cylinder;

a motor configured to drive a reciprocating movement of the piston in the cylinder;

a valve configured to control air flow into and out of the cylinder; and a control apparatus configured to control driving power applied to the motor based on at least one of a level of the driving power applied to the motor, a position of the piston, and an internal pressure of the cylinder, wherein the control apparatus is configured to, based on an operating speed of the compressor being less than a preset reference speed, vary a compensation value configured to be applied to a current of the motor during each of a plurality of stroke periods, the plurality of stroke periods being divided according to a change of the internal pressure.

11. The compressor of claim 10, wherein the plurality of stroke periods comprise:

an initial compression period in which the internal pressure increases to a preset reference level;

a compression increase period in which the internal pressure increases by an increase rate greater than a preset increase rate;

a valve opening period in which the internal pressure remains within a preset rising range;

a re-expansion period in which the internal pressure decreases by a decrease rate greater than a preset decrease rate; and a suction period in which the internal pressure remains within a preset minimum range.

12. The compressor of claim 11, wherein the control apparatus is configured to:

apply a first compensation value to the current during the initial compression period, the first compensation value being 50%; and apply a second compensation value to the current during the compression increase period, the second compensation value being greater than the first compensation value.

13. The compressor of claim 11, wherein the control apparatus is configured to apply no compensation value to the current during the valve opening period.

14. The compressor of claim 11, wherein the control apparatus is configured to:

apply a first compensation value to the current during the re-expansion period, the first compensation value being −50%; and apply a second compensation value to the current during the suction period, an absolute value of the second compensation value being less than an absolute value of the first compensation value.

15. A method of a compressor control apparatus for controlling a compressor, the compressor control apparatus including an inverter configured to convert power received from an external power source into driving power for driving a motor of the compressor, and a controller configured to generate a pulse width modulation (PWM) control signal for controlling a switching operation of the inverter and to apply the PWM control signal to the inverter to control the switching operation, the method comprising:

comparing an operating speed of the compressor to a preset reference speed;

based on the operating speed being less than the preset reference speed, determining a stroke period of the compressor based on at least one of a magnitude of the driving power, a position of a piston of the compressor, or an internal pressure of a cylinder of the compressor, the cylinder accommodating a reciprocating movement of the piston therein;

determining a compensation value corresponding to the determined stroke period among a plurality of reference compensation values that are preset for a plurality of stroke periods, respectively;

applying the compensation value to a control command for generating the PWM control signal for the determined stroke period; and generating the PWM control signal according to the control command and applying the PWM control signal to the inverter.

16. The method of claim 15, wherein the plurality of stroke periods comprise:

an initial compression period in which the internal pressure increases to a preset reference level;

a compression increase period in which the internal pressure increases by an increase rate greater than a preset increase rate;

a valve opening period in which the internal pressure remains within a preset rising range;

a re-expansion period in which the internal pressure decreases by a decrease rate greater than a preset decrease rate; and a suction period in which the internal pressure remains within a preset minimum range.

17. The method of claim 16, wherein the plurality of reference compensation values comprise:

positive compensation values configured to be applied to a control commend during the initial compression period and the compression increase period; and a negative compensation value configured to be applied to a control commend during the re-expansion period.

18. A method of a compressor control apparatus for controlling a compressor, the compressor control apparatus including an inverter configured to convert power received from an external power source into driving power for driving a motor of the compressor, and a controller configured to (i) detect at least one of a magnitude of the driving power, a position of a piston of the compressor, or an internal pressure of a cylinder that accommodates a reciprocating movement of the piston therein, (ii) generate a pulse width modulation (PWM) control signal for controlling a switching operation of the inverter based on a detection result, and (iii) apply the PWM control signal to the inverter to control the switching operation, the method comprising:

applying a first compensation value to a duty ratio of the PWM control signal during a first period between a rear end time point at which the piston is positioned at a rear end of the cylinder and a time point at which the piston is positioned at an intermediate position;

applying a second compensation value to the duty ratio during a second period between the time point at which the piston is positioned at the intermediate position and a time point at which a valve of the cylinder is opened, the second compensation value being greater than the first compensation value;

applying no compensation value to the duty ratio during a period between the time point at which the valve is opened and a time point that is prior to a front end time point at which the piston is positioned at a front end of the cylinder by a predetermined time period;

applying a third compensation value to the duty ratio during a third period between (i) the time point that is prior to the front end time point by the predetermined time period and (ii) a time point at which discharge of compressed air from the cylinder is ended; and applying a fourth compensation value to the duty ratio during a fourth period between the time point at which the discharge of compressed air from the cylinder is ended and a time point at which the piston returns to the rear end of the cylinder.

* * * * *